US006018973A

United States Patent [19]

Surina

[11] Patent Number: 6,018,973

[45] Date of Patent: Feb. 1, 2000

[54] ROTARY FORMING APPARATUS AND METHOD OF ROTARY FORMING

[76] Inventor: Michael Surina, 34 Laurendale Ave., Waterdown, Ontario, Canada, L0R 2H3

[21] Appl. No.: 09/155,933

[22] PCT Filed: Apr. 10, 1997

[86] PCT No.: PCT/CA97/00241

§ 371 Date: Apr. 29, 1999

§ 102(e) Date: Apr. 29, 1999

[87] PCT Pub. No.: WO97/37787

PCT Pub. Date: Oct. 16, 1997

[30] Foreign Application Priority Data

Apr. 10, 1996 [CA] Canada ..... 2173776

[51] Int. Cl.[7] ..... B21D 28/36

[52] U.S. Cl. ..... 72/190; 83/328

[58] Field of Search ..... 72/184, 190, 452.7; 83/321, 327, 328

[56] References Cited

U.S. PATENT DOCUMENTS 1,581,236 4/1926 Speer .
3,066,542 12/1962 Einhiple .
4,732,028 3/1988 Bodnar .

FOREIGN PATENT DOCUMENTS

WO 93/20973 10/1993 WIPO .

*Primary Examiner*—Lowell A. Larson
*Attorney, Agent, or Firm*—Ohlandt, Greeley, Ruggiero & Perle

[57] ABSTRACT

A rotary forming apparatus (10) having a pair of lower and upper die carrier units (14, 16) each of which is rotatable on opposite sides of a workpiece (W), and having a plurality of die supports (22, 24) swingably mounted on each of the die carriers, and supporting upper and lower dies (82, 80), and having die support guide roller pairs (66, 68) mounted together on a common axis side by side on each the die supports and located adjacent to the leading or trailing edge of the respective die support, and a guide plate (56) alongside one end of each die carrier, and, guide grooves (58, 60, 62, 64) formed in each guide plate for receiving the pairs of die support guide rollers (66, 68), the grooves being formed so as to define inner and outer guide surfaces (74, 76), with one of the die guide rollers engaging one of the inner and outer surfaces and the other of the die guide rollers engaging the other of the inner and outer guide surfaces. Also disclosed is a method of rotary forming using such apparatus.

16 Claims, 9 Drawing Sheets

ROTARY FORMING APPARATUS AND METHOD OF ROTARY FORMING

TECHNICAL FIELD

The invention relates to a rotary forming apparatus, for forming strip sheet material while it is moving continuously along a forming line and to a method of rotary forming. The formations may take the form of indentations, or openings, or any other shapes which may be formed in such strip sheet material.

BACKGROUND ART

The forming of shapes or openings in moving strip sheet material has usually been confined in the past to forming longitudinal formations by what is called roll forming. Various different methods have been proposed for forming openings, or transverse formations, in moving strip material. In simple cases, a series of stationary presses are located along a production line and a piece of strip material is moved along in a start-stop fashion. Every time the material stops in registration with a press, the press closes and makes a formation after which the press opens and the material moves once more. However, these systems are relatively slow, since the material must stop at each press, and start again, for each formation.

Another system is the use of flying dies. These flying dies are somewhat similar to flying shears used in roll forming of continuously moving strip material. Various forms of piercing or forming dies can be placed on a flying die apparatus, and the strip material can move slowly through the flying die apparatus. By suitable movement mechanisms in the die apparatus the dies are first of all accelerated up to the speed of the moving material. And they are then closed on the material while the material is moving. The dies must then be opened again and returned to their starting position.

This system again is relatively slow, since the flying die apparatus must move forwardly and backwardly along the axis of the moving sheet metal in a repetitive manner.

Certain improved systems for rotary forming are shown in U.S. Pat. No. 4,732,028, dated Mar. 22, 1988, inventor E. R. Bodnar.

In this system two rotary die carriers are provided with a plurality of separate die supports each having dies mounted on the supports. There are upper and lower dies, to operate on both sides of the sheet of metal, and the upper and the lower rotary carriers had to be carefully synchronised to ensure that each pair of dies are closed and opened on the sheet of metal in precise registration. However, this system required that each of the die supports be rotatable relative to the rotary carriers. Consequently, some form of guide means had to be provided to guide the rotary die supports so that they came into registration with one another, and just prior to closing on the metal and remained in registration until they had opened again.

The system provided die support guides which guided the leading and the trailing edges of each die support by means of guide pins and end guide cams for guiding the pins so as to ensure such registration. The end guide cams were located at opposite ends of the die carriers. One guide cam guided the leading guide pins and the other guide cam guided the trailing guide pin, of each die support. This arrangement was therefore relatively complex to engineer and build.

Another of the problems with this system was that when the system was used for piercing openings in the sheet of metal, the blanks or slugs or a sheet of metal which had been removed from the opening tended to remain in the dies, and there was some difficulty in ensuring that they were removed.

The die carriers themselves were rotatably mounted on bearings at each side of the carriers, and were suitably driven through gear means known in the art. However, the die supports were supported in generally semi-cylindrically shaped transverse grooves formed along the length of the die carriers, and it was found to be somewhat of a problem to both lubricate the semi-cylindrical grooves and at the same time keep them free of dirt and other contaminants.

A still further problem associated with the earlier apparatus described is the problem of matching the rotary movement of the dies with the linear movement of the workpiece. The linear movement of the workpiece is constant and unchanging. However, it is obvious that the rotary movement of the die supports, and their dies, causes their linear speed to go through a slight change from a point just before contact with the workpiece, and during contact, and to a point just after contact with the workpiece where the dies separate once more.

During dead centre contact, the dies are clearly moving at the same linear speed as the sheet metal strip workpiece, and for that instant, in the same linear direction. However, just before the dies contact the workpiece, they are still moving angularly towards the workpiece. The linear speed of the two dies at this point is thus slightly less than the linear speed of the workpiece.

Similarly, after closure, as the two dies start to separate from the workpiece, their linear speed relative to the workpiece tends to slow down.

This effect is of little importance where the workpiece is thin, and where the depth of the formation is relatively slight. However, with a thicker workpiece or where the depth of the formation is greater, then the reduced speed of the dies before and after closing relative to the workpiece, will either damage the workpiece or the dies or both. As a result, some attempt must be made to accommodate a linear translation of the dies relative to the workpiece so that they can temporarily speed up just prior to closing and speed up again just after opening.

For all of these reasons, it is desirable to provide a rotary apparatus for forming continuously moving strip sheet material in which the design and operation of the die supports and the die carriers is improved and the problem of contamination and lubrication is removed, and in which the problem of knocking out the slugs is improved, and in which the problems relating to the matching of the speed of the dies with the sheet material is solved, and in which the guiding of the die supports is carried out in a simpler and more effective manner.

DISCLOSURE OF THE INVENTION

With a view to achieving the foregoing advantages and providing an improved rotary apparatus, the invention comprises a rotary forming apparatus having a pair of lower and upper die carrier units, each of which is rotatable whereby they may rotate together on opposite sides of a workpiece, and having a plurality of die supports swingably mounted on each of the die carriers, the die supports being adapted to swing to and fro relative to their die carriers, about axes which are spaced radially from the axis of their die carrier, and being adapted to support upper and lower dies, and each die support having die support guide roller pairs mounted together on a common axis side by side and located adjacent to the leading or trailing edge of the respective die support, and die guide grooves formed in a guide plate means alongside each end of said die carrier for receiving said pairs of die support guide rolls, said groove means being formed so as to define inner and outer guide surfaces, with one of said die guide rollers in each pair engaging one of said inner and outer surfaces and the other of said die guide rollers in that pair engaging the other of said inner and outer die surfaces.

The invention further provides such a rotary forming apparatus in which the die supports are themselves rotatably mounted by external bearings at each end of each die support, the external bearings being formed in respective right and left hand portions of the die carrier, whereby the surfaces of the die supports are free of lubrication and contamination.

The invention further provides such a rotary forming apparatus and wherein slug ejection means are provided for each die support and there being ejector operating means associated with said die carrier and engageable with said ejection means as said carrier rotates bringing each support into a lower downwardly facing position, whereby ejection of each slug causes the slug to fall away under the influence of gravity.

The invention further provides such a rotary forming apparatus in which the matching of the rotary linear speeds of the upper and lower rotating die support guides with the constant linear speed of the workpiece is achieved through adjustments between the drive gear which drives one of the upper and lower die carriers and the carrier shaft of that carrier, so that a certain degree of slack is present between the drive gear and the carrier shaft. The drive gear of the driven carrier is coupled to the other carrier (ie either the upper or the lower carrier) by an idler gear, so that the relative rotational speeds of the two carriers remains constant. The slack or play permitted between the drive gear and the driven shaft of the driven carrier allows the rotational speeds of the upper and lower carriers to speed up, slow down, and speed up once more, slightly, thereby allowing the linear speeds of the upper and lower dies to adjust themselves momentarily to the linear speed of the sheet material.

The invention also provides a method of rotary forming using the aforesaid apparatus.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

MODES OF CARRYING OUT THE INVENTION

Figure 1:
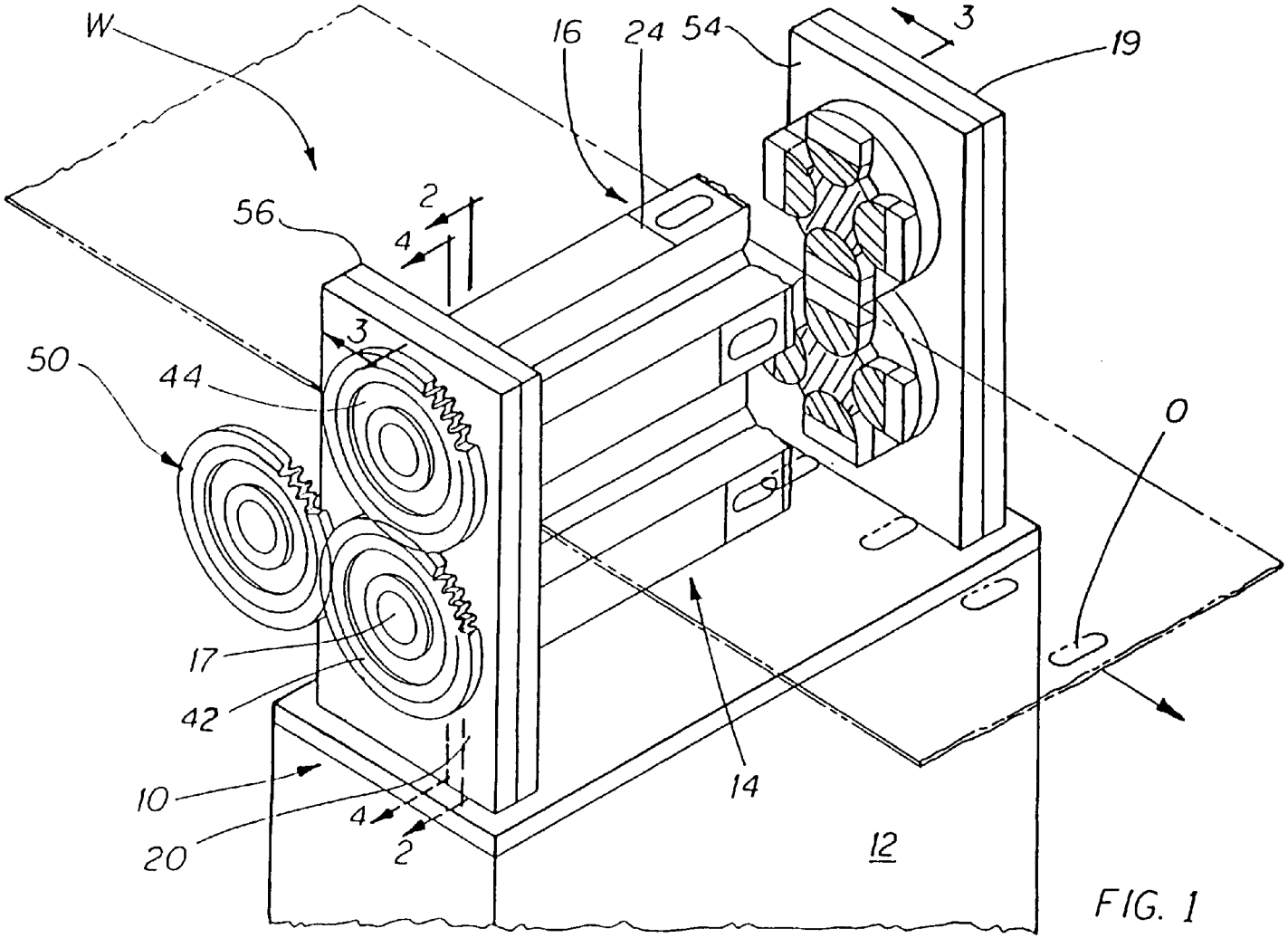
FIG. 1 is a perspective illustration of a rotary forming apparatus in accordance with the invention.

Referring first of all to FIG. 1, it will be seen that the illustration there is in respect of a rotary forming apparatus indicated generally as 10, which is illustrated here for the sake of explanation of the invention and without limitation to any of the features described.

The rotary forming apparatus 10 comprises a base 12, a lower die carrier 14 and an upper die carrier 16, having carrier shafts 17 and 18. Respective right and left hand plates 19 and 20 support the lower and upper die carriers, in a manner to be described below. A strip workpiece indicated as W is shown as passing between the lower and upper die carriers.

For the purposes of this illustration, the workpiece W is shown as being formed, by the dies carried in the lower and upper die carriers so as to produce a series of transverse spaced apart openings O. It will, of course, be understood that any type of formation can be made by the use of the invention whether it is an indentation or an opening or both, and the opening may be formed with flanges around the edge of the opening of lesser or greater depth in a manner to be described below.

For the purposes of this description, therefore, the term "forming" is deemed to include any such forming operation whether it is by way of mere indentation or blanking an opening or blanking and forming the edges of an opening.

It will be appreciated from FIG. 1 that the nature of the rotary operation of the invention of the apparatus 10 permits it to rotate continuously while the workpiece is moved continuously between the upper and lower die carriers, thus producing a series of spaced apart formations in the workpiece, and providing numerous advantages over other types of processes used for forming spaced apart formations in a workpiece, as described above.

Die Carriers

Figure 2:
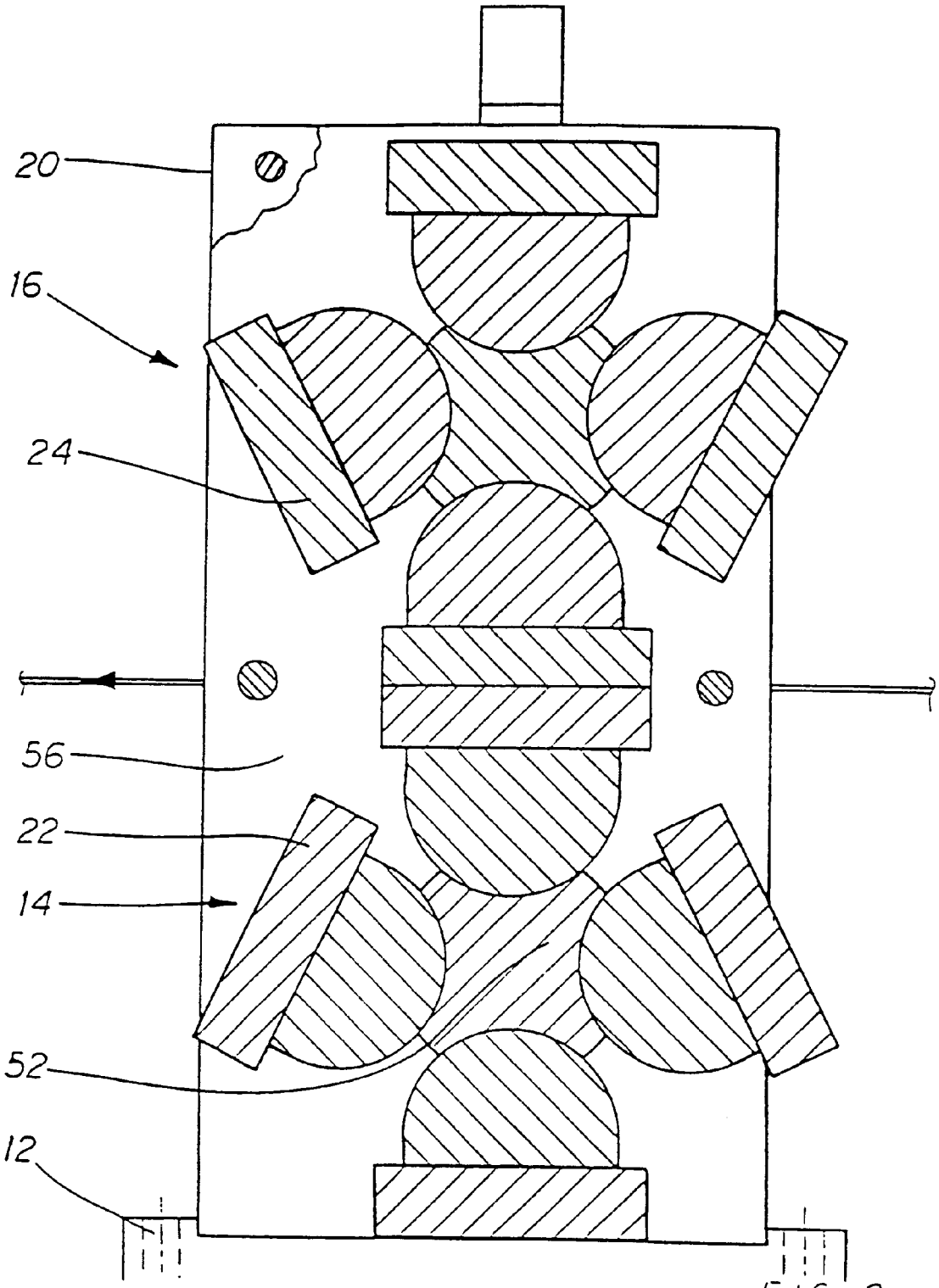
FIG. 2 is a section along the line 2—2 of FIG. 1.
Figure 3:
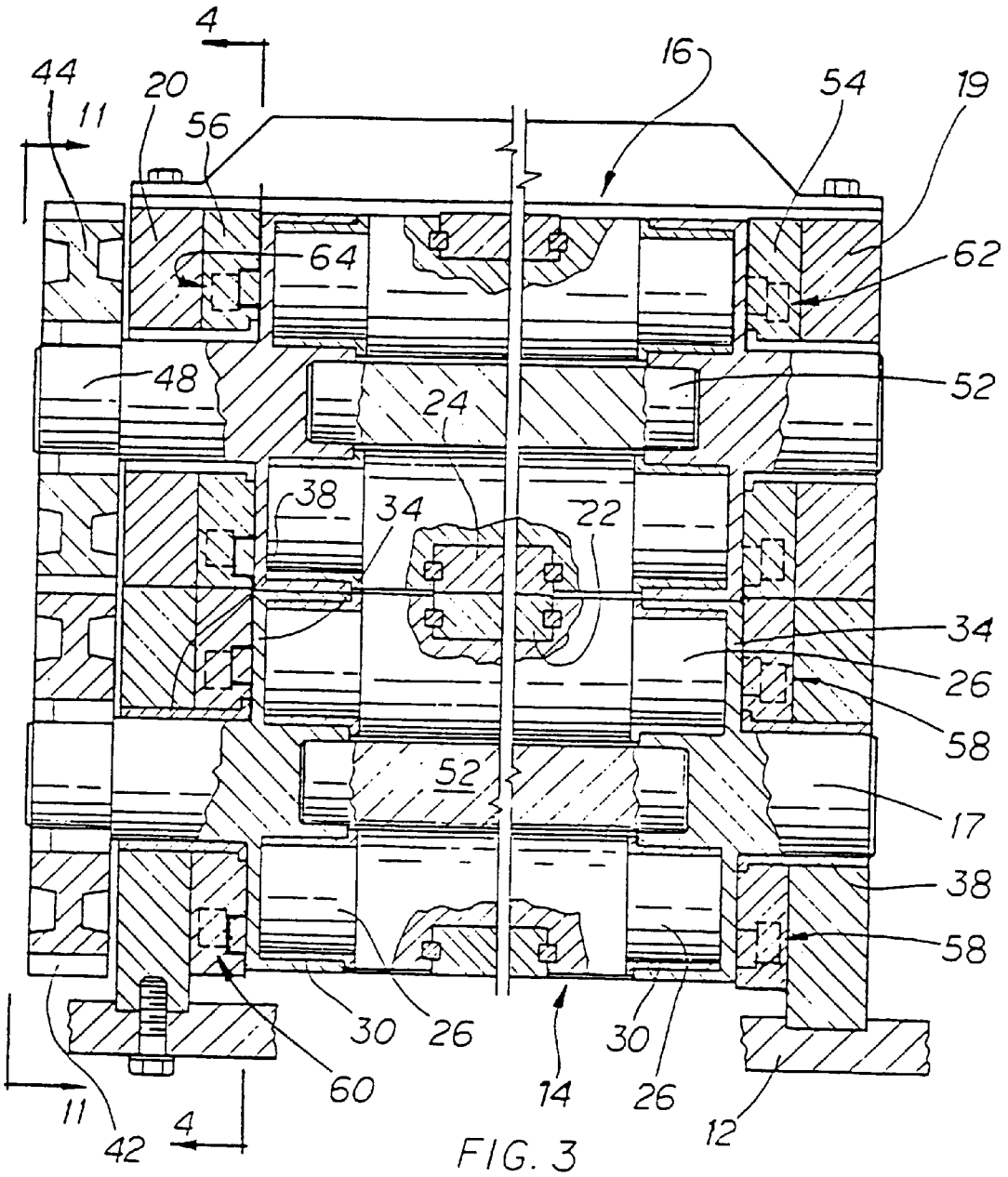
FIG. 3 is a section along the line 3—3 of FIG. 1.

Referring now to FIGS. 2 and 3, it will be seen that each of the lower and upper die carriers is provided with a plurality of, in this case, four, semi rotary lower and upper die supports 22 and 24. Each of the die supports is swingably mounted between bearings 26, 28, at opposite ends of each support, the bearings being received in bearing sleeves 30 and 32. The bearing sleeves 30 and 32 are received in respective end members 34 and 36, which are of generally four pointed star shape. At the centres of each of the bearing supports, there are provided main die carrier bearings 38 and 40, receiving shafts 17, and 18, formed in end plates 19 and 20.

A pair of lower and upper gears 42 and 44 are coupled to the die carrier shafts 17 and 18, and link the two die carriers for rotation in unison in opposite directions.

One of the die carrier shafts, for example the lower carrier shaft 17, is driven by its respective gear 42 through a drive gear train 50 by any suitable motor means (not shown). The other gear, (i.e., the upper gear 44) is then an idler gear, coupling the upper and lower carriers together for rotation in unison, in opposite directions. It is of course possible that the upper gear 44 could be the driven gear, in which case the lower gear 42 would be the idler.

Figure 9:
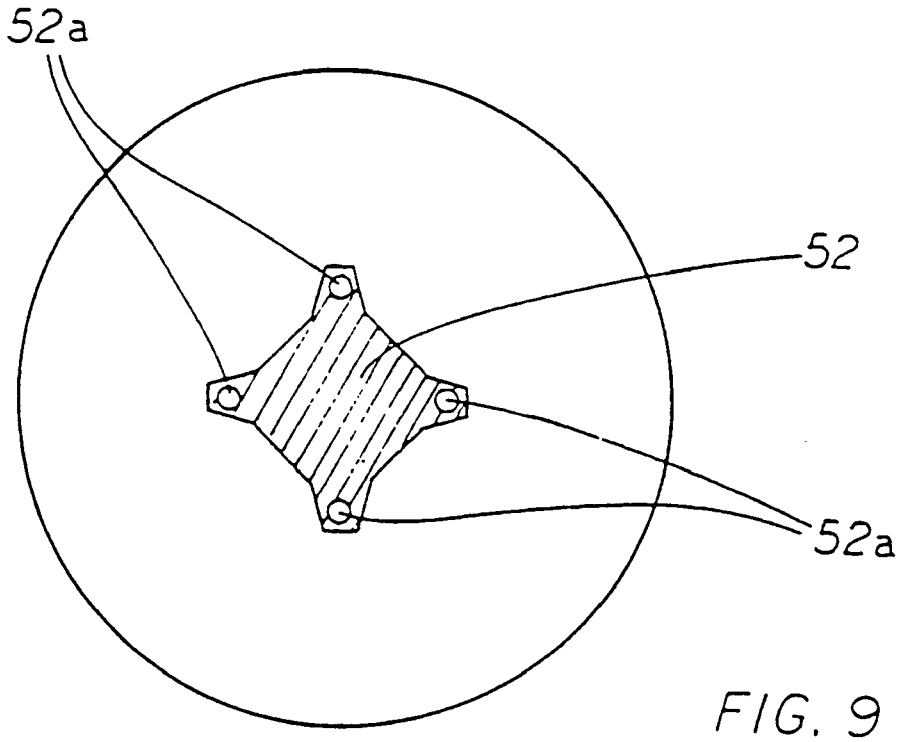
FIG. 9 is a section along 9—9 of FIG. 3.
Figure 10:
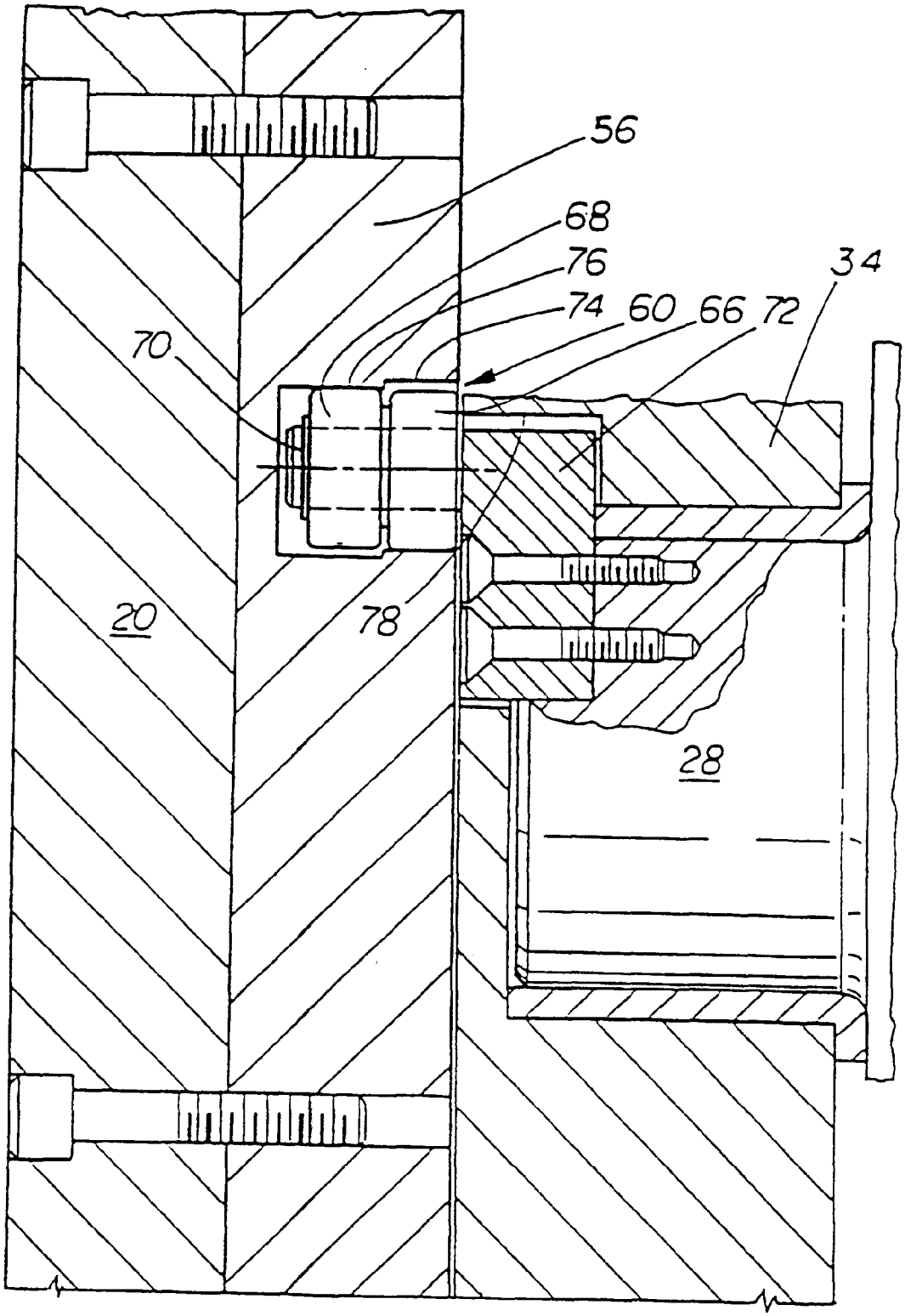
FIG. 10 is a greatly enlarged section corresponding to FIG. 6.
Figure 11:
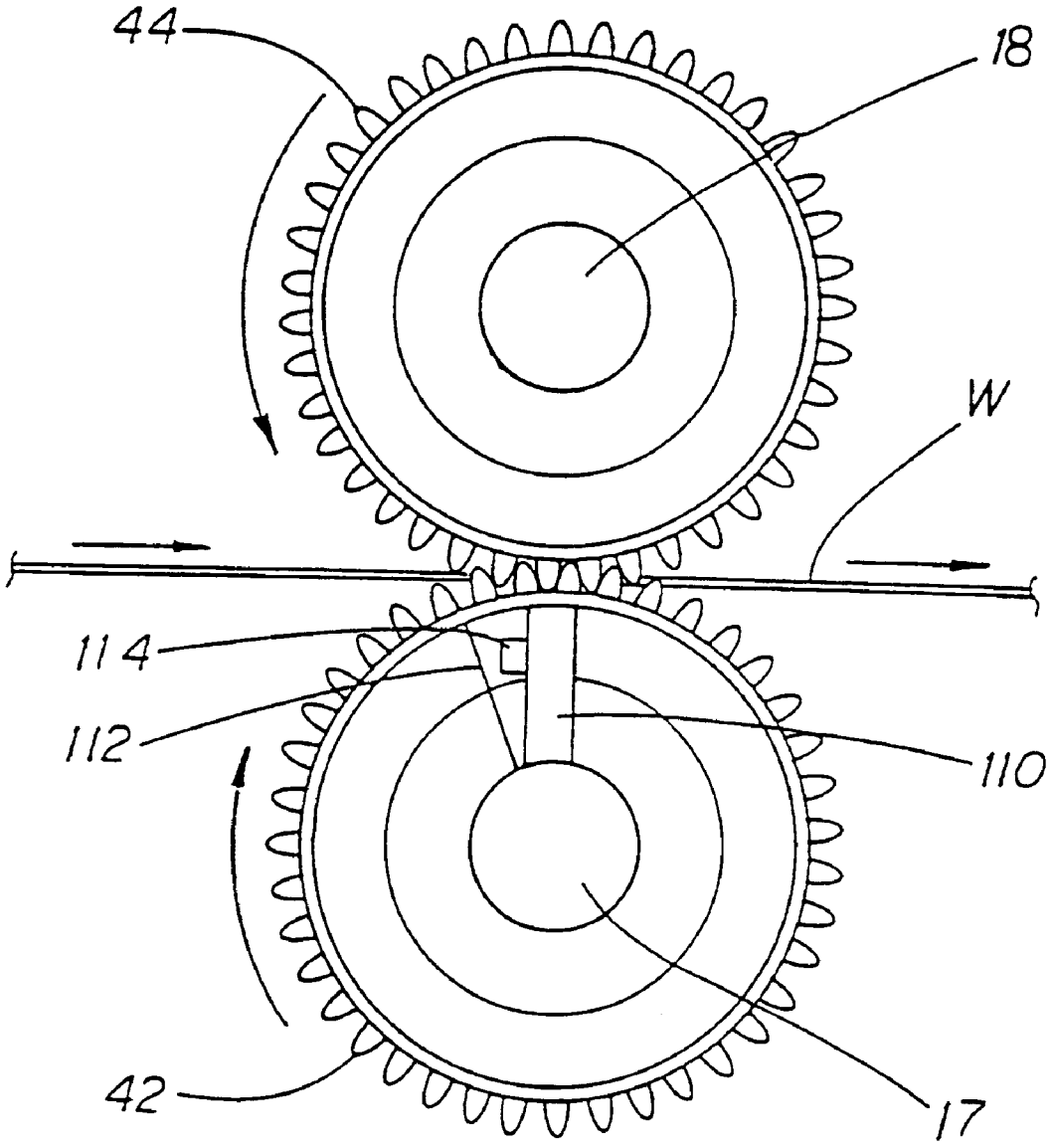
FIG. 11 is a schematic illustration of a side view of the drive train illustrating the play present between the drive gear and the driven shaft to allow for self adjustment of the linear speed of the dies to match the speed of the sheet material.

A spacer shaft 52 extends between the right and left hand end members 34 and 36, and the end members are bolted to the spacer shaft. The spacer shaft, in FIG. 2, appears in profile as cylindrical, but is in fact of generally rectangular shape in section, with extended portions 52A at each corner of the rectangle, to receive fastening bolts (FIG. 9).

Die Support Guides

In order to guide the die supports as they rotate, two right and left hand guide plates 54 and 56 are secured to the side members 18 and 20, on opposite sides of the rotary die carriers. Each of the guide plates 54 and 56 is formed with respective lower and upper guide grooves 58, 60 and 62, 64 (FIG. 4).

The guide grooves will be seen to be of eccentric shape, in elevation, for reasons to be described below.

Each of the lower and upper die supports 22 and 24 are provided with pairs of inner and outer die support guide rollers 66, 68, at each end. The guide rollers 66 and 68 are two separate substantially identical rollers, secured on a common axle 70, and mounted on mounting plates 72 bolted to the bearings 26, 28, of the respective die supports 22, 24.

Figure 4:
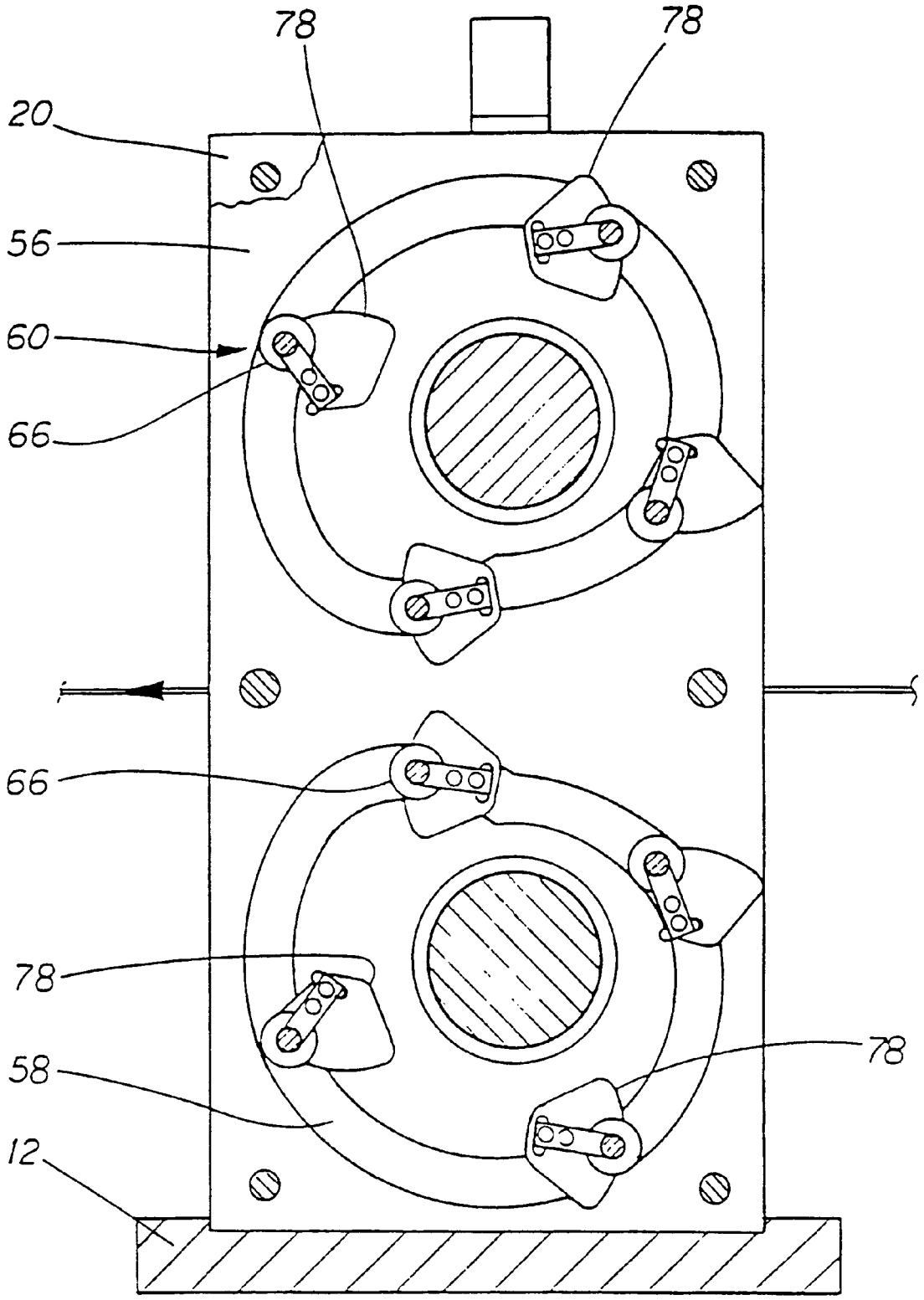
FIG. 4 is a section along the line 4—4 of FIG. 3.

The guide rollers are adapted to be received in the respective guide grooves 58, 60, 62, 64 in the guide plates 54, 56 (FIG. 4).

Figure 5:
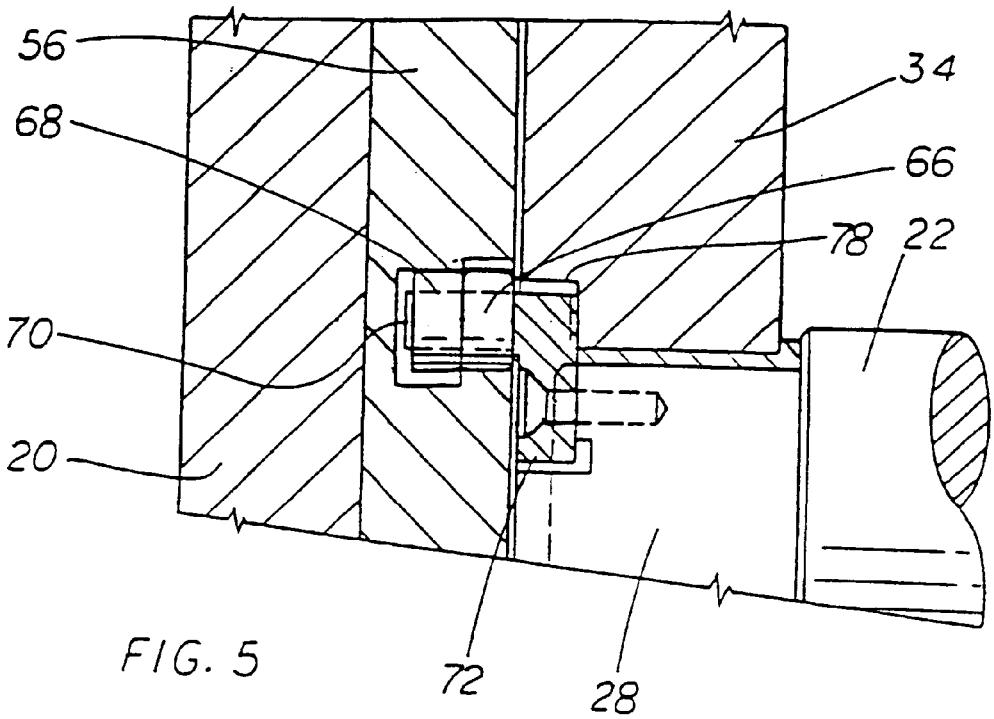
FIG. 5 is an enlarged elevational view of the die guide rollers and the die support bearing.
Figure 6:
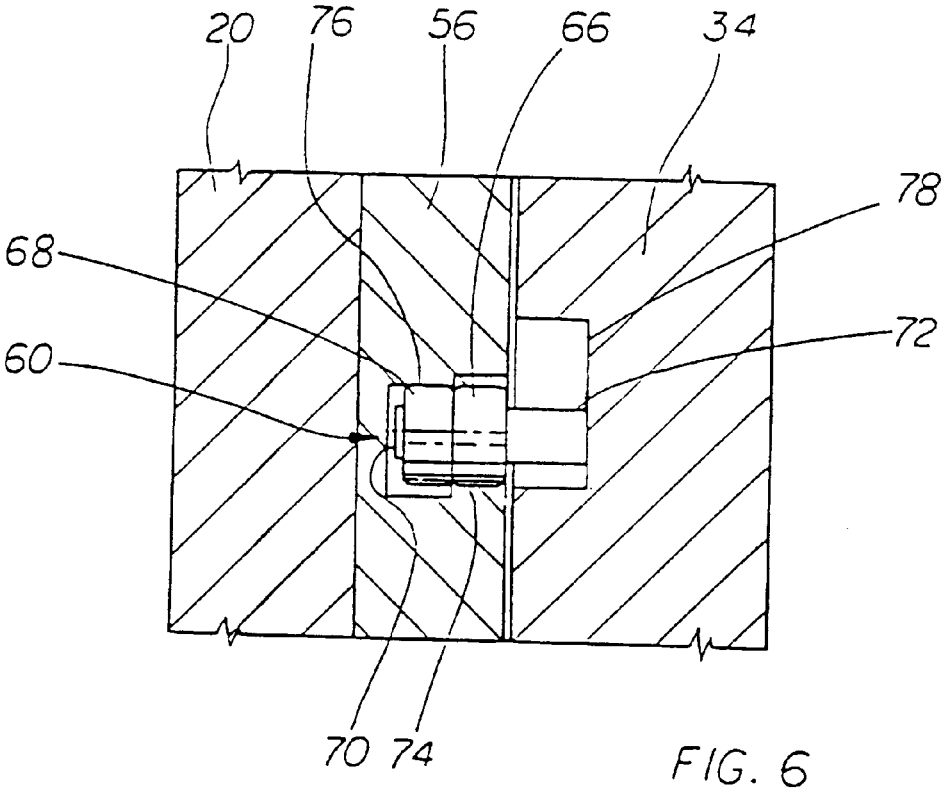
FIG. 6 is a section of the die guide rollers, and the guide grooves.

From FIG. 5 it will be seen that the guide rollers, although being mounted in pairs on the common axle 70, comprise inner guide rollers 66 and outer guide rollers 68. The two guide rollers have a predetermined diameter. However, each guide groove 58, 60, 62, 64, is formed with respective inner groove portions 74 and outer groove portions 76. Each of the groove portions has a width greater than the diameter of the rollers. However, the outer groove portion is offset radially with respect to the inner groove portion 74. Consequently, the inner guide roller rides on the one surface of the inner groove portion 74 and the outer guide roller 68 rides on the opposite surface of the outer guide groove portion 76. In this way, when the die carriers are rotating, and carrying with them the four die supports, the respective pairs of guide rollers 66 and 68 on each of the die supports 22,24 will travel around the inner and outer guide groove portions 74 and 76 respectively. It is, however, a significant feature of the invention that due to the fact that the inner guide roller 66 contacts one surface of the inner guide groove portion 74, but not the other, and due to the fact that the outer guide roller 68 contacts only the opposite surface of the outer guide groove portion 76, the two guide rollers will be able to rotate freely in opposite directions.

This is due to the fact that the width of each of the two guide groove portions is greater than the diameter of the respective guide rollers. It will be seen that this contrarotation of the two guide rollers can take place freely without causing any rubbing friction between either of the guide rollers, and the out-of-contact surfaces of their respective guide groove portions.

It is by this means that the entire guidance of each of the die supports 22, 24 can be performed by respective pairs of 7 inner and outer guide rollers 66, 68 mounted on common axles at each end of the leading edge of the die supports 22, 24. It will, of course, be appreciated that by simply re-engineering the guide grooves, the guide rollers could be placed along the trailing edge of the die supports. In either case, substantially total and complete control is achieved over the angular orientation of each of the die supports around 360 degrees of its travel.

Figure 7:
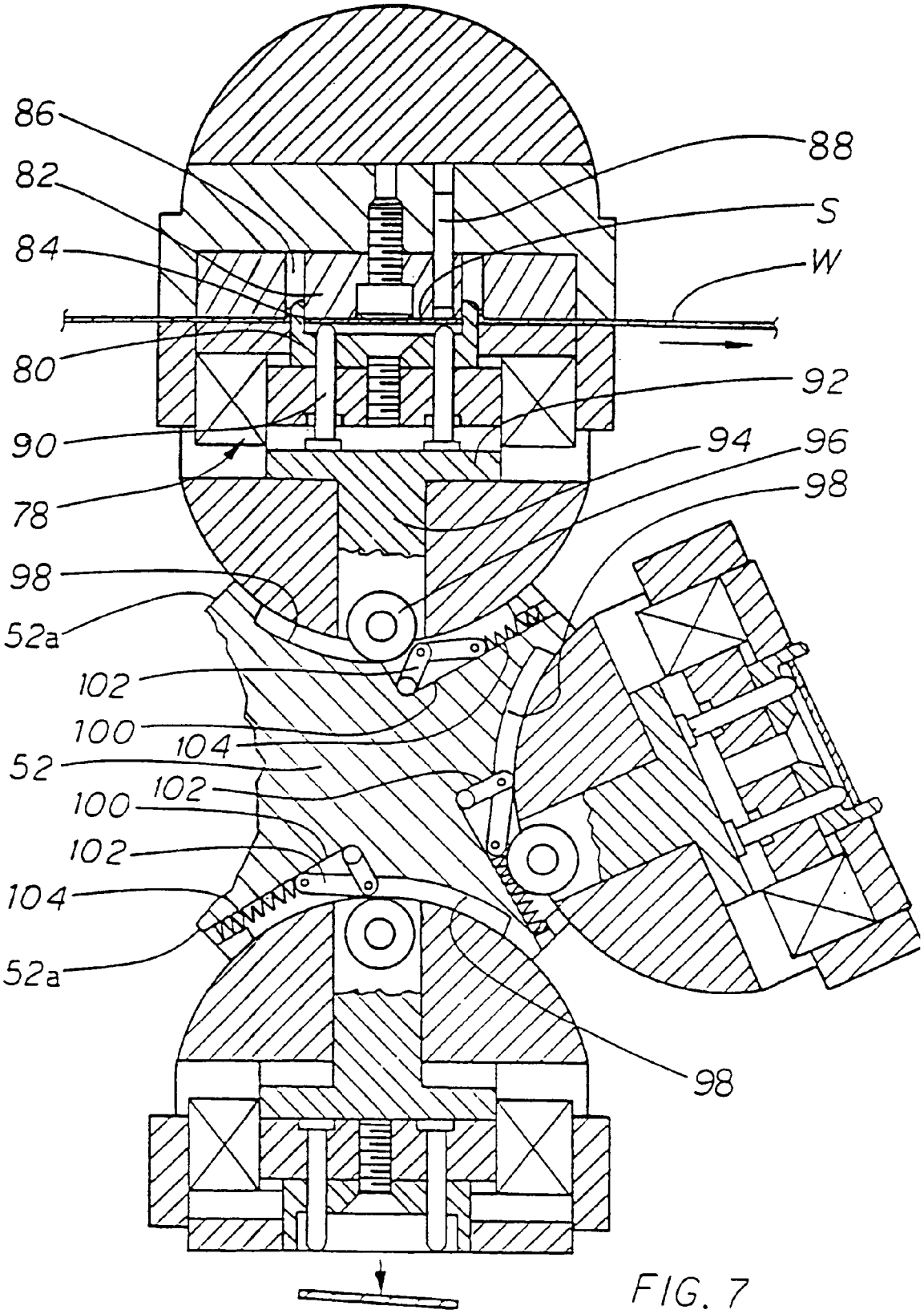
FIG. 7 is an enlarged view of the lower die carrier showing the slug ejector means.
Figure 8:
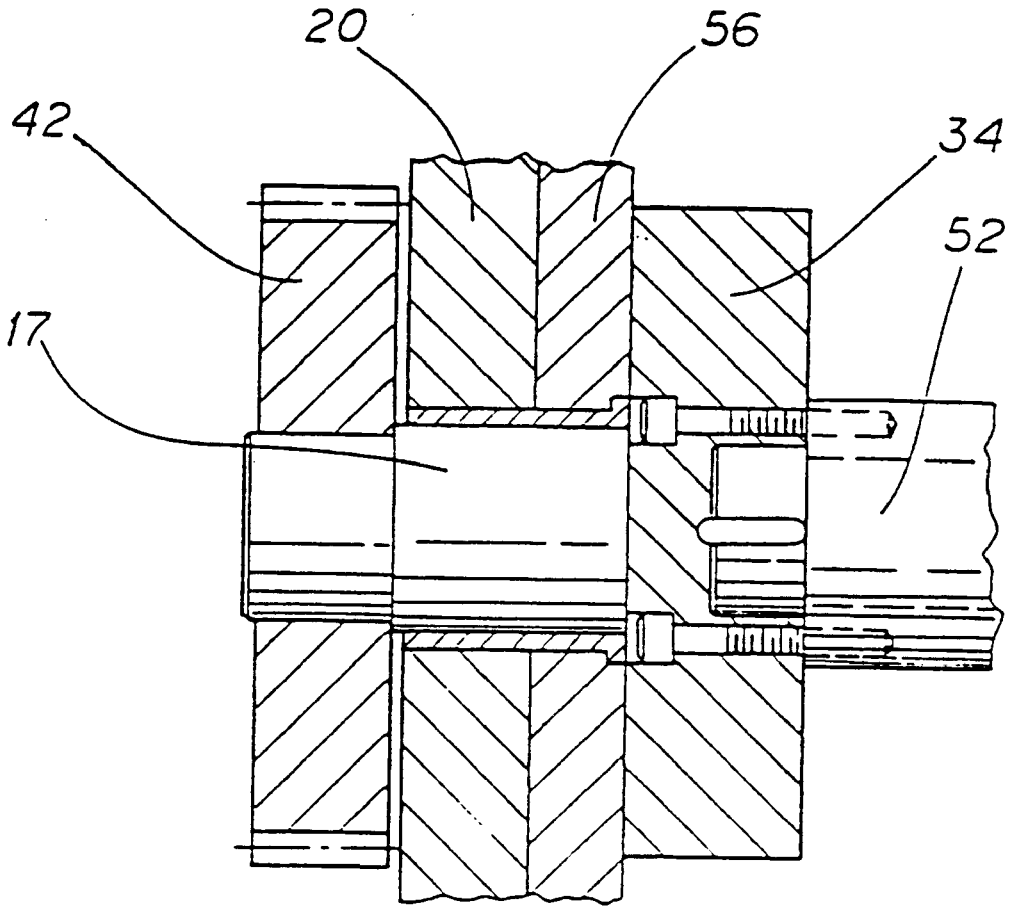
FIG. 8 is a section along 8—8 of FIG. 3.

Each of the die supports 22, 24 is formed with a die receiving recess 78 and lower and upper die blocks are shown fitted in the recess, for the sake of clarity. As shown in FIG. 7, the lower die 80 is a female die and the upper die 82 is a male die. The female die 80 defines upstanding walls 84, and the male die 82 defines recesses 86 to receive the walls 84. Die guide pins 88 are provided extending from the male die to be received in guide recesses in the female die in a manner well known in the art.

In this way, a central slug S (FIG. 7) can be struck out by the male die 82 through the centre of the female die, and at the same time, the edges of the opening in the workpiece can be formed as flanges F, by the upstanding walls 84 of the female die 80.

Slug Ejection Mechanism

In order to eject the slugs S from the centre of the female die 80, a pair of ejector pins 90 are mounted in female die 80, and are normally retracted downwardly into the centre of the female die 80, The ejector pins 90 are mounted on an ejector plate 92, having an ejector shaft 94 extending through its respective lower die carrier 22, and terminating in a cam roller 96.

The lower die carrier spacer shaft 52 is formed with four semi cylindrical recesses 98 for receiving the cam rollers 56. At one end of the semi cylindrical recess, there is provided a cavity 100. Within the cavity 100 is scissors linkage 102 operated by a spring 104. As the lower die carrier rotates, each die support will swing relative to it's die carrier, due to the guidance of the guide rolls in the guide grooves. As the lower die support swings in one direction, the respective cam roller will roll over the respective scissors linkage which will flatten out compressing spring 104.

As the die lower die support swings in the opposite direction, its cam roller 96 will engage its scissors linkage 102, which will then lock against the shoulder of the recess 98. This will cause the cam roller 96 and the ejector shaft 94 to be forced inwardly into the die support. This position corresponds to the six o'clock position of the lower die carrier. This movement causes the ejector plate 92 and ejector pins 90 to move downwardly, thereby ejecting the slug S in a downward direction, leaving it to fall freely under the influence of gravity.

Linear Speed Compensation

As mentioned above, the apparatus provides for compensation between the constant linear speed of the workpiece and the slight variations in linear speed of the dies and die supports, at positions just before and just after closing.

In accordance with this embodiment of the invention, this is achieved by means of introducing a slight degree of play between the driven gear 42 and the carrier shaft 17 on which it is mounted. The lower carrier shaft 17 is not keyed directly to its gear 42. A radial drive rod 110 is secured to the end of lower shaft 17 and extends radially to one side thereof. Gear 42 is formed with recess 112 which receives rod 110. A spring 114 is secured in a bore formed in gear 42 on one side of recess 112. Spring 114 engages rod 110, urging rod 110 towards the opposite side of the recess 112. The spring is sufficiently strong that during normal operation of the upper and lower carriers, i.e. when the dies are not engaging the workpiece, the rod is held against the one side of the recess. However as the lower and upper dies start to close on the workpiece, the workpiece is in fact moving slightly faster than the linear speed of the dies. There is a slight degree of play between the drive gear 42, and the lower shaft 17 on which it is mounted. When the workpiece is engaged by the dies, this will cause the dies to momentarily increase speed to a very slight degree, thus matching the speed between the dies to the workpiece. This adjustment takes place as a result of the rod 110 being enabled to swing in recess 112 and compress spring 114 for a fraction of a second. By the time the dies reach the dead centre position the spring has recovered and moved the rod back to its normal position against the opposite side of the recess, permitting the dies to conform to the linear speed of the workpieces at this point. However, as the dies start to open again, there is again a need for adjustment in speed, i.e. the dies must momentarily increase in speed and the drive rod a spring allow for this adjustment to occur momentarily, once again. In this way, at all critical times just before closing, during closing, and when just opening, the slight degree of play between the driven gear 42 and the lower carrier shaft 17 allows the linear speeds of the dies to match the linear speed of the workpiece in a simple yet highly effective manner.

The foregoing is a description of a preferred embodiment of the invention which is given here by way of example only. The invention is not to be taken as limited to any of the specific features as described, but comprehends all such variations thereof as come within the scope of the appended claims.

I claim:

1. A rotary forming apparatus (10) having a pair of lower and upper die carrier units (14,16), each of which is rotatable whereby they may rotate together on opposite sides of a workpiece (W), and having a plurality of die supports (22,24) swingably mounted on each of the die carriers, the die supports being adapted to swing to and fro relative to their die carriers, about axes which are spaced radially from the axis of their die carrier, and being adapted to support upper and lower dies (82,80), said apparatus comprising;

die support guide roller pairs (66,68) mounted together on a common axis (70) side by side on each said die support (24) and located adjacent to the leading or trailing edge of the respective die support;

guide plate means (56) alongside one end of said die carrier, and, guide groove means (58,60,62,64) formed in each said guide plate means for receiving said pairs of die support guide rolls (66,68), said groove means being formed so as to define inner and outer guide surfaces, with one of said die guide rollers engaging one of said inner and outer surfaces (74,76) and the other of said die guide rollers engaging the other of said inner and outer guide surfaces (74,76).

2. A rotary forming apparatus as claimed in claim 1 wherein said die supports (22,24) are themselves rotatably mounted by external bearings (26,28) at each end of each die support, the external bearings being formed in respective right and left hand portions (34,36) of the respective die carrier (14,16), whereby the surfaces of the die supports are free of lubrication and contamination.

3. A rotary forming apparatus as claimed in claim 1 wherein said die supports (22,24) are themselves rotatably mounted by external bearings (26,28) at each end of each die support, the external bearings being formed in respective right and left hand portions (34,36) of the respective die carrier (14,16), whereby the surfaces of the die supports are free of, lubrication and contamination.

4. A rotary forming apparatus as claimed in claim 3 and wherein said guide rollers (66,68) are attached to said external bearing (26) of said die supports.

5. A rotary forming apparatus as claimed in claim 4 wherein said end portions of said die carriers (14,16) are formed with endwise extending axial bearings (38,40) about which said die carriers are rotatable, said axial bearings being received in bearing recesses in right and left support plates (19,20) for supporting said die carriers.

6. A rotary forming apparatus as claimed in claim 5 and including two said guide plate means (54,56) each said guide plate means being mounted between a respective end of said die carriers (14,16) and the adjacent side plate (19,20), and opening means extending through said guide plate means for reception of axial bearings therethrough.

7. A rotary forming apparatus as claimed in claim 1 and wherein slug ejection means (90) are provided for each die support on said lower die carrier (22) and there being ejector operating means (96) associated with said lower die carrier (22) and engageable with said ejection means as said carrier rotates bringing each support into a lower downwardly facing position, whereby ejection of each slug causes the slug to fall away under the influence of gravity.

8. A rotary forming apparatus as claimed in claim 7 wherein said slug ejection means (90) comprise ejector pins (90) slidably mounted in each of said lower dies (80), and ejector plate means (92) connected to said pins (90) and operating mechanism (96) connected to said plate means (92) and responsive to rotation of said lower die carrier to cause operation of said pins (90) when a said lower die support is at a lower position in the rotation of said lower die carrier.

9. A rotary forming apparatus as claimed in claim 8 wherein each said lower die support (22) includes ejector means (90) as aforesaid, and wherein said lower die carrier includes ejector operating means (96) as aforesaid for each said die support.

10. A rotary forming apparatus as claimed in claim 1 including means (110,112,114) for matching of the linear speeds of the upper and lower rotating die supports and dies, with the constant linear speed of the workpiece.

11. A rotary forming apparatus as claimed in claim 10 and wherein the speed matching means (110,112,114) comprises a driven gear (42) for driving one of the upper and lower die carriers, said driven gear being mounted on one of the carrier shafts so that a certain degree of play is present between the gear and the shaft, and means (114) biassing said gear into a predetermined rotational position relative to the shaft and said biassing means being yieldable to allow movement between the shaft and the gear thereby allowing the linear speeds of the upper and lower dies to adjust themselves momentarily to the linear speed of the sheet material.

12. A method of forming a moving strip sheet workpiece (W) by means of rotary forming apparatus (10) having a pair of lower and upper die carrier units (14,16), each of which is rotatable whereby they may rotate together on opposite sides of a workpiece, and having a plurality of die supports (32,24) swingably mounted on each of the die carriers, the die supports being adapted to swing to and fro relative to their die carriers, about axes which are spaced radially from the axis of their die carrier, and being adapted to support upper and lower dies, and comprising;

guiding the die supports (22,24) by guide roller pairs (66,68) mounted together an a common axis side by side on each said die support and located adjacent each end of the respective die support;

moving the guide rollers along guide groove means (58,60,62,64) formed in guide plate means (54,56) for receiving said pairs of die support guide rolls, said groove means being formed so as to define inner and outer guide surfaces (74,76), with one of said die guide rollers engaging one of said inner and outer surfaces (74,76) and the other of said die guide rollers engaging the other of said inner and outer guide surfaces (74,76).

13. A method of rotary forming as claimed in claim 12 including the step of rotatably mounting the die supports by external bearings (26,28) at each end of each die support, the external bearings being formed in respective right and left hand portions (34,36) of the respective die carrier, whereby the surfaces of the die supports are free of lubrication and contamination.

14. A method of rotary forming as claimed in claim 12 and including the steps of ejecting slugs by slug ejection means (90) provided for each die support on said lower die carrier and operating ejector means (96) engageable with said ejection means as said carrier rotates bringing each support into a lower downwardly facing position, whereby ejection of each slug causes the slug to fall away under the influence of gravity.

15. A method of rotary forming as claimed in claim 14 and including the step of ejecting said slugs by ejector pins (90) slidably mounted in each of said lower dies, and ejector plate means (92) connected to said pins (90) and said operating mechanism (96) being connected to said plate means whereby rotation of said lower die carrier causes operation of said pins when a said lower die support is at a lower position in the rotation of said lower die carrier.

16. A method of rotary forming as claimed in claim 12 and including the step of matching the linear speeds of the upper and lower rotating die supports and dies, with the constant linear speed of the workpiece, by means of permitting play between the drive gear and a carrier shaft, thereby allowing the linear positions of the upper and lower dies to adjust themselves to the linear speed of the sheet material.

* * * * *